US007824022B2

(12) United States Patent
Masumi et al.

(10) Patent No.: US 7,824,022 B2
(45) Date of Patent: Nov. 2, 2010

(54) INK-JET PRINTER AND IMAGE FORMING METHOD

(75) Inventors: Satoshi Masumi, Odawara (JP); Ai Kondo, Hino (JP)

(73) Assignee: Konica Minolta Medical & Graphic, Inc. (JP)

( * ) Notice: Subject to any disclaimer, the term of this patent is extended or adjusted under 35 U.S.C. 154(b) by 566 days.

(21) Appl. No.: 11/818,750

(22) Filed: Jun. 15, 2007

(65) Prior Publication Data

US 2007/0296787 A1 Dec. 27, 2007

(30) Foreign Application Priority Data

Jun. 22, 2006 (JP) ..... 2006-172272

(51) Int. Cl.
*B41J 2/175* (2006.01)

(52) U.S. Cl. ..... 347/85; 347/84; 347/65

(58) Field of Classification Search ..... 347/65, 347/84, 85, 100, 44, 45, 47
See application file for complete search history.

(56) References Cited

U.S. PATENT DOCUMENTS 6,513,434 B1 * 2/2003 Nakazawa et al. ..... 101/466
2003/0218661 A1 * 11/2003 Okada et al. ..... 347/100
2004/0114007 A1 * 6/2004 Leighton ..... 347/88
2006/0221156 A1 * 10/2006 Calamita et al. ..... 347/88
2007/0223980 A1 * 9/2007 Fukumoto et al. ..... 399/348

FOREIGN PATENT DOCUMENTS

| | | | |
|---|---|---|---|
| JP | 6-9714 | | 1/1994 |
| JP | 2001-31892 | | 2/2001 |
| JP | 2001-40068 | | 2/2001 |
| JP | 2001-55507 | | 2/2001 |
| JP | 2001-220526 | | 8/2001 |
| JP | 2001-310937 | | 11/2001 |
| JP | 2001-310938 | | 11/2001 |
| JP | 2003266685 | A * | 9/2003 |
| JP | 2004-34543 | | 2/2004 |
| JP | 2005007574 | A * | 1/2005 |
| JP | 2005-290246 | | 10/2005 |

* cited by examiner

*Primary Examiner*—Matthew Luu
*Assistant Examiner*—Rut Patel
(74) *Attorney, Agent, or Firm*—Cantor Colburn LLP

(57) ABSTRACT

Disclosed is an ink-jet printer ejecting an ink comprising a cationic-polymerizable compound onto a recording medium, wherein the ink-jet printer comprises ink-contact members which constitute an ink tank retaining the ink and an ink jet supply passage of from the ink tank to a recording head ejecting the ink and the ink-contact members are each comprised of a material which does substantially not undergo electron transfer with the ink.

20 Claims, 4 Drawing Sheets

INK-JET PRINTER AND IMAGE FORMING METHOD

This application claims priority from Japanese Patent Application No. JP2006-172272 filed on Jun. 22, 2006, which is incorporated hereinto by reference.

FIELD OF THE INVENTION

The present invention relates to an ink-jet printer using an ink containing a cationic-polymerizable composition, having a novel constitution, and an image forming method by use thereof.

BACKGROUND OF THE INVENTION

Recently, ink-jet recording systems, which enable simple and low-priced image formation, are applied to various printing fields, for instance, photography, various kinds of printing and special printing such as marking and color filters. In general, aqueous ink-jet inks composed of water as a main solvent are printed on dedicated paper provided with ink-absorptivity, but there have been put to practical use ink-jet recording systems other than aqueous type ones, for example, a phase change ink-jet system of using a solid wax ink at room temperature, a solvent type ink-jet system which uses an ink containing mainly a quick-drying solvent, and a actinic ray curing type ink-jet system.

Specifically, an ultraviolet-curing ink-jet system has recently been noted in terms of being relatively low-odor and quick-drying and enabling recording on a non-ink-absorptive recording medium, as compared to a solvent type ink-jet system, and there were disclosed various techniques of actinic ray curing type ink-jet recording.

There is practically used an actinic ray curing type ink-jet ink using a radical-polymerizable compound, typically, (meth)acrylate. Recently, there have also been proposed a actinic ray curing ink-jet ink using a cationic-polymerizable compound and an ink-jet printer by use thereof, based on the reason of adhesiveness to a recording medium, low-odor and reduced polymerization inhibition, as set forth in, for example, JP-A Nos. 2005-290246 and 2004-34543 (hereinafter, the term JP-A refers to Japanese Patent Application publication).

Further, in ink-jet printers, ink tanks and materials constituting an ink-supplying route between an ink tank and an ink-jet recording head often employ metals such as stainless steel and aluminum in terms of durability and simplicity in processing. Specifically, to remove impurities contained in an ink for prevention of plugging, there is provided a filter in the ink-supplying route, in which metals are employed as the material to constitute the filter.

It was proved that when performing image formation using a actinic ray curing ink-jet ink containing a cationic-polymerizable compound and an ink-jet printer constituted of the metals described above, precipitates are produced in the ink by working environment of the ink-jet printer and materials constituting the ink-supplying passage and the produced precipitates tend to clog the ink-supplying passage or reach the nozzle section, causing ejection troubles. Thus, the contact of a conductive material with a reactive conductive ink causes an undesired electrochemical reaction, resulting in formation of degradation products or polymeric products of ink constituents within the ink passage or an ink head, causing ejection troubles. For instance, when two kinds of metal members exist in the conduction state within the ink supply passage, contact of an ink with the metals forms a cell, giving rise to an electromotive force between the two kinds of metals, causing an electrochemical reaction accompanied with unexpected ink-curing (polymerization) reaction.

Further, when an alloy such as stainless steel is in contact with a conductive ink, the metal surface is not in a homogeneous state, resulting in microscopically conducting state between the metals and the ink, causing an electrochemical reaction on the metal surface.

In general, precipitation of actinic ray curing ink-jet is often due to leakage of actinic rays, against which there have been measures. However, there has been no description with respect to occurrence of precipitates due to transfer of electrons (electrochemical reaction) and there is no disclosure that such electron transfer can be controlled by component material or constitution of materials of ink-contact members.

SUMMARY OF THE INVENTION

In view of the foregoing, the present invention has come into being and it is an object of the invention to provide an ink-jet printer which uses a actinic ray curing ink-jet ink containing a cationic-curable compound and is capable of inhibiting formation of precipitates within the interior of the printer.

One aspect of the invention is directed to an ink-jet printer ejecting an ink comprising a cationic-polymerizable composition onto a recording medium, wherein ink-contact members which constitute an ink tank retaining the ink and an ink supply passage of from the ink tank to a recording head ejecting the ink are each a material which does substantially not undergoing electron transfer with the ink.

Another aspect of the invention is directed to an ink-jet printer ejecting an ink comprising a cationic-polymerizable composition onto a recording medium, wherein an ink tank retaining the ink or an ink supply passage of from the ink tank to a recording head ejecting the ink is provided with a filter, and the filter and a portion adjoining the filter are each comprised of a material which does substantially not undergoing electron transfer with the ink.

Thus, in the ink containing a cationic-polymerizable composition, a co-existing photo-acid generator usually generates an acid upon exposure to actinic energy rays and the generated acid initiates polymerization of the cationic-polymerizable monomer. When such an ink containing a cationic-polymerizable composition is retained in an ink tank or in an ink flow passage over a long duration and electrons are donated by an ink-contact member, an acid is generated in the ink through transfer of the electrons, without being exposed to actinic energy rays, whereby polymerization is initiated, producing an undesired polymeric composition. As a result of extensive studies with respect to means for inhibiting production of such an undesired polymeric composition, it was discovered that such problems could be overcome by constituting an ink-contact member of the ink-jet printer with a material which performs substantially no electron transfer.

Further, it was discovered that when the ink-contact members were constituted of a single or plural electrically conductive materials and each of the conductive materials exhibited a corrosion current density of less than 0.03 $\mu A/cm^2$ which was determined from a polarization curve in the ink, no production of polymeric composition occurred and printing was conducted without causing any problem.

DETAILED DESCRIPTION OF THE INVENTION

Ink-Jet Printer

The ink-jet printer of the invention is constituted mainly of an ink tank retaining an ink containing a cationic-polymerizable composition, an ink supply passage to supply the ink from the ink tank to a recording head, a recording head for ejecting the ink supplied through the ink supply passage onto a recording medium and an actinic ray-exposing light source for curing ink droplets deposited on the recording medium, and there may be provided a filter or an intermediate tank in the ink supply passage between the ink tank and the recording head.

Figure 1:
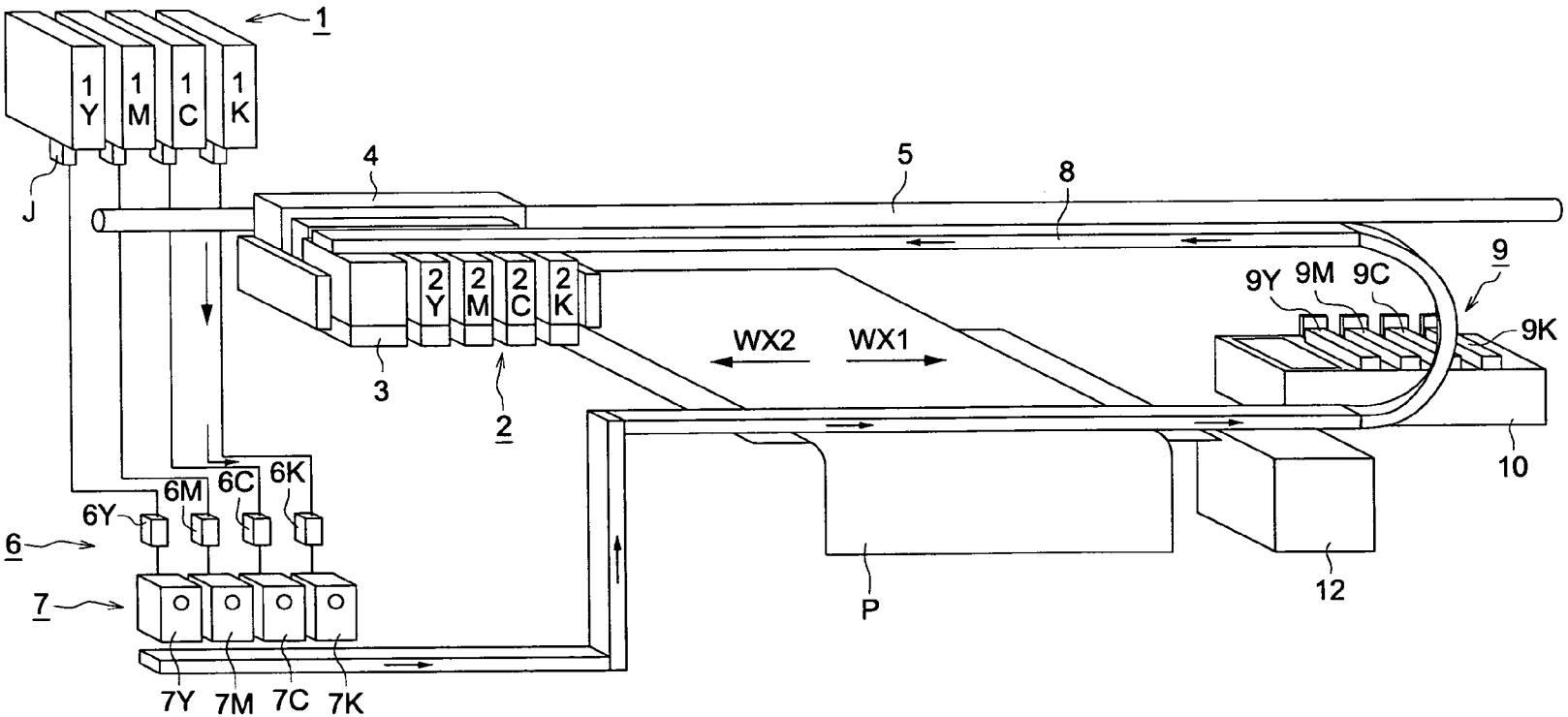
FIG. 1 illustrates an overall constitution of an ink-jet printer relating to the invention, which is provided with a filter and an intermediate tank.

FIG. 1 illustrates an overall constitution of an ink-jet printer relating to the invention, which is provided with a filter and an intermediate tank.

Numeral "1" designates an ink tank 1 retaining and supplying an ink containing a cationic-polymerizable composition, which is constituted of, for example, a yellow ink tank 1Y, a magenta ink tank 1M, a cyan ink tank 1C and a black ink tank 1K. Designation J is a joint connecting the ink tank I with the ink supply passage.

Numeral "2" designates a recording head for ejecting ink droplets onto a recording medium to form an image and is constituted of a yellow recording head 2Y, a magenta recording head 2M, a cyan recording head 2C and a black recording head 2K. Numeral "3" designates an actinic energy ray source for exposing an ultraviolet ray as an actinic energy ray to the ink deposited on a recording medium.

Numeral "4" designates a carriage and a carriage 4 which is integrally mounted with the recording head 2 and the energy ray source 3 and scans a recording medium P by moving back and forth with being guided by a carriage guide 5, as shown by arrows WX1 and WX2 to form an image on the recording medium P.

Numeral "6" designates a filter box which is constituted of a filter box 6Y for yellow, a filter box 6M for magenta, a filter box 6C for cyan and a filter box 6K for black. Numeral "7" designates an intermediate tank, which is constituted of an intermediate tank 7Y for yellow, an intermediate 7M tank for magenta, an intermediate tank 7C for cyan and an intermediate tank 7K for black.

Recording ink is supplied from the ink tank 1 to the intermediate tank 7 and further from the intermediate tank 7 to the recording head via an ink supply passage 8. The ink supply passage 8 is constituted of supply passages for a yellow ink, a magenta ink, a cyan ink and a black ink and the individual single color inks are independently supplied from the ink tank 1 to the recording head through the ink supply passage 8.

Numeral "10" designates a maintenance unit which conducts a recovery treatment for the recording head 2 and is provided with a suction cap for capping the recording head 2. Numeral "12" designates a waste ink vessel for retaining waste ink, which receives an ink forcedly ejected from the recording head 2 in flushing and accumulates it.

Figure 2:
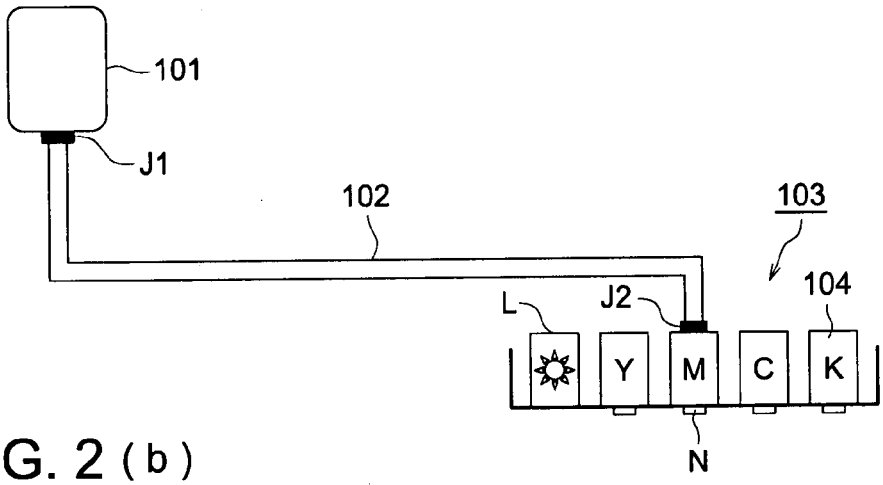
FIGS. 2(*a*), 2(*b*) and 2(*c*) each illustrate an example of constitution of ink supply passage of the ink-jet printer of the invention.
Figure 2:
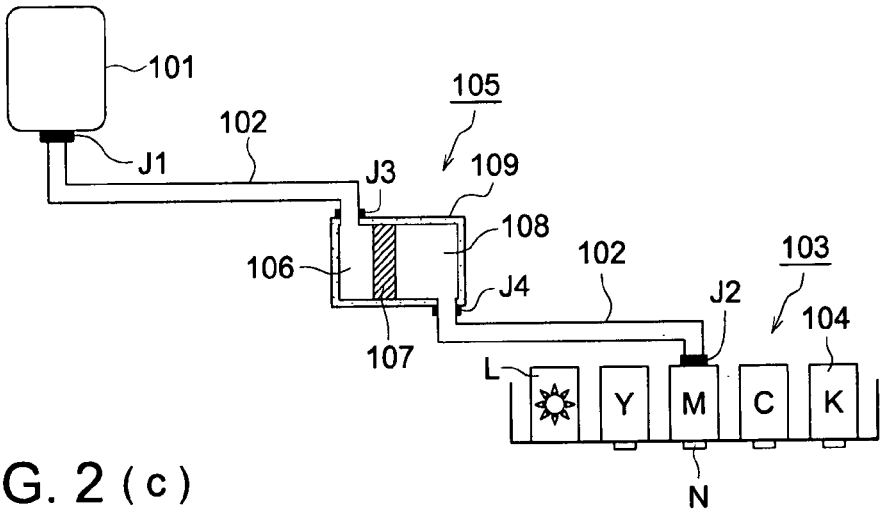
Figure 2:
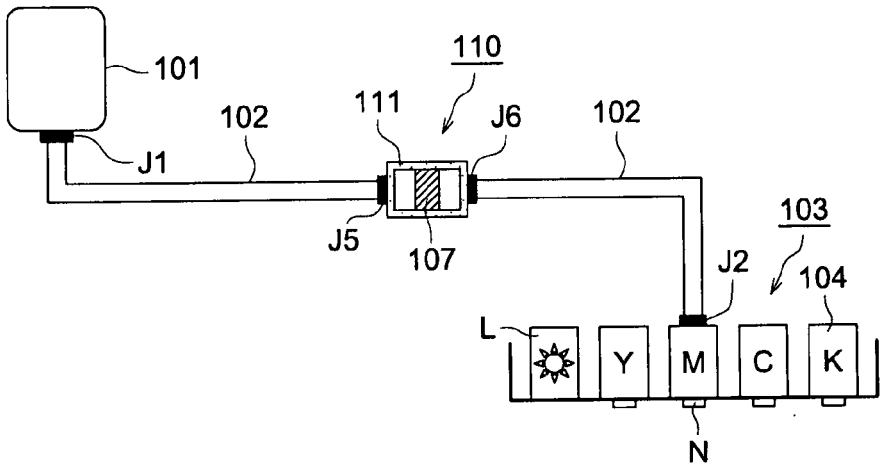

FIGS. 2(*a*), 2(*b*) and 2(*c*) each illustrates an example of constitution of ink supply passage of the ink-jet printer of the invention.

In FIG. 2(*a*), a ink tank 101 is connected to an ink supply passage 102 via a joint J1 and the end of the ink supply passage 102 is connected via a joint J2 to a recording head 104 housed in a carriage 103. Ink droplets are ejected, based on image data, onto a recording medium from a nozzle N of the recording head 104, in which Y, M, C and K designate recording heads for yellow, magenta, cyan and black, respectively. Subsequently, an actinic energy ray is instantly irradiated from an actinic energy ray source L onto the deposited ink to cure the image.

FIG. 2(*b*) is an example in which an intermediate tank unit 105 is provided in the course of the ink supply passage 102. An outfall of an ink tank 101 is connected via a joint J1 to an ink supply passage 102, which is further connected via a joint J3 to an intermediate tank unit 105. After having been supplied via the joint J3 to an intermediate tank pre-room 106, the ink is filtered with a filter 107 to remove contaminants and is supplied to an intermediate tank 108. Subsequently, the intermediate tank 108 is connected via a joint J4 to the ink supply passage 102, which is an ink supply line of supplying the filtered ink retained in the intermediate tank 108 to the recording head. In FIG. 2(*b*), numeral 109 designates a portion adjoining the filter 107. Hereinafter, such a portion adjoining a filter is also denoted as a filter-adjoining portion.

In FIG. 2(*c*) a filter box 110 is provided in place of the inter mediate tank unit 105 of FIG. 2(*b*). There is provided a filter 107 in the interior of the filter box of which ink entering side and ink emerging side are connected to the ink supply passage 102 via joints J5 and J6, respectively and which is the ink supply line of supplying the ink, after removing contaminants, to the recording head 104. In FIG. 2(*c*), numeral 111 designates a filter-adjoining portion adjacent to the filter 107.

As described above, in FIGS. 2(*a*)-2(*c*), there is shown, for simplicity, only a line of supplying an ink to a recording head for magenta, but there are provided similar supply lines in a recording head for yellow, a recording head for cyan and a recording head for black. There are shown only components necessary for explanation but there are also provided a controller of for the recording head as well as a magnetic valve or a branch joint to control ink supply.

The ink-jet printer of the invention, is featured in that in the ink-jet printer or the ink supply line shown in FIGS. 1 and 2(*a*)-2(*c*), for example, (1) ink-contact members constituting an ink tank to retain an ink and an ink supply passage of from the ink tank to a nozzle of a recording head ejecting the ink are each comprised of a material which does not substantially undergo electron transfer with an ink or (2) there is provided an ink tank to accumulate an ink or a filter in the ink supply passage of from the ink tank to a nozzle to eject the ink, and the filter and a filter-adjoining portion are a material which does not substantially undergo electron transfer with an ink.

In the invention, the ink-contact portions (or members), which include an ink tank, an ink supply passage, an intermediate tank unit, a filter box and joints connecting them, and are portions (or members) which are directly in contact with an ink containing a cationic-polymerizable composition, relating to the invention. In the ink supply line shown in FIG. 2(*a*), for example, the ink-contact portions include the interior of the ink tank 101, the interior of the ink supply passage 102, the joints J1 and J2, and the interior of the recording head 104. In the ink supply line shown in FIG. 2(*b*), the ink-contact portions include the interior of the ink tank 101, the interior of the ink supply passage 102, the joints J1 and J2, the filter 107 and the filter-adjoining portion 107 within the intermediate tank unit 105 and the interior of the recording head 104. In the ink supply line shown in FIG. 2(*c*), the ink-contact portions include the interior of the ink tank 101, the interior of the ink supply passage 102, the joints J1, J2, J5 and J6, the filter 107 and filter-adjoining portion within the filter box 110 and the interior of the recording head 104.

In one feature of the invention, the member constituting the ink-contact portion, that is, the ink-contact member is a material which does not substantially undergo electron transfer with an ink. Thus, there is not performed electron transfer between the material and the ink. Herein, "undergo electron transfer with an ink" is to oxidize or reduce at least one of constituents of the ink, and when a material having such a characteristic is used in the ink-contacting portion, for instance, an ink and a member capable of undergoing electron transfer with the ink are in contact with each other over a long period of time, electron transfer between them results in formation of precipitates and when the formed precipitates reach the recording head, there result troubles such as nozzle clogging, nozzle deficiency and oblique-ejection.

In one aspect of the invention, an ink-jet printer is featured in that the ink-contact portion is constituted of a member which does not substantially cause electron transfer with an ink. Further, at least one chosen from constitutions described below or a combination thereof prevents development of a potential difference in the ink-contact portion, whereby substantial electron transfer with the ink is prevented, inhibiting production of precipitates.

There are cited:

(1) all of the ink-contact members being constituted of insulation materials, (2) at least a part of the ink-contact members being constituted of a single conductive material, (3) an ink-contact member is constituted of plural conductive materials and the plural conductive materials being insulated from each other, (4) the ink-contact members being constituted of a single or plural conductive and the corrosion current density of each of the conductive materials being less than 0.03 $\mu A/cm^2$ in the polarization curve in the ink, (5) a material constituting an ink-contact member being a metal element having a lower ionization tendency than that of a hydrogen element, and specifically as material constituting a filter and a filter-adjoining portion, (6) the filter and the filter-adjoining portion being constituted of a single insulating material, (7) the filter and the filter-adjoining portion being constituted of a single conductive material, (8) the filter and the filter-adjoining portion being constituted of plural conductive materials and the plural conductive materials being insulated from each other, (9) the filter and the filter-adjoining portion being constituted of a single or plural conductive materials and the corrosion current density in the polarization curve of each of the conductive materials in the ink being less than 0.03 $\mu A/cm^2$,

(10) the filter and the filter-adjoining portion each being constituted of a metal element exhibiting a lower ionization tendency than a hydrogen element, and also as a material constituting an intermediate tank,

(11) the intermediate tank being constituted of a metal and the surface of the metal being subjected to a passivation treatment, and

(12) the metal being aluminum and the passivation treatment being an alumite treatment (also called an anodic oxidation treatment).

There will be further described below the member which does not substantially cause electron transfer with an ink.

In the invention, insulating materials relating to the foregoing (1) and (5) are preferably those exhibiting a surface resistance of $1\times10^8\Omega\cdot cm$ or more, and more preferably $1\times10^{10}\ \Omega\cdot cm$ or more. The surface resistance of insulating materials is measured using a circular electrode (for example, High Rester IP, HR probe, produced by Mitsubishi Yuka Co., Ltd.) in accordance with JIS K6991. An insulating material related to the invention may be composed of a single material exhibiting a surface resistance as defined above, or may be a form in which a metal material is used as a substrate and the portion which is in contact with an ink is covered with the above-described insulating material to provide insulating capability.

Insulating materials usable in the invention include, for example, rubber, plastic materials, fibers and ceramics. Specifically, in an ink supply passage requiring flexibility, there are usable, for example, nitrile rubber (NBR), hydrogenated nitrile rubber (HNBR), fluorinated rubber (FKM), perfluororubber (FFKM), milable type silicone rubber, fluorosilicone rubber (FVMQ), ethylene propylene rubber (EPM, EPDM), styrene butadiene rubber (SBR), silicone rubber (VQM), acryl rubber (ACM, ANM), butyl rubber (IIR), chlorosulfonated polyethylene rubber (CSR), epichlorohydrin rubber (CO, ECO), chloroprene rubber (CR).

There are used a polyolefin, polypropylene, polyethylene, polyester, vinyl chloride, polycarbonate, TFE (tetrafluoroethylene), PFA (perfluoroalkoxyresin; tetrafluoroethylene-pearluorinated alkylvinyl ether copolymer), FEP (tetrafluoroethylene-hexafluoropropylene copolymer), FFKM, FEPM and PI (polyimide), for an ink tank, an intermediate tank, a filter box, a joint and the like.

There are usable, as a metal substrate covered with an insulating material, for example, iron, aluminum, copper, nickel, tin, zinc, lead, silver, gold and alloys of these metals or with other metals.

There are generally usable metallic materials for use in constructions, as conductive materials relating to the foregoing (2), (3), (6) and (7). Examples thereof include iron, aluminum, copper, nickel, tin, zinc, lead, silver, gold and alloys of these metals or with other metals, and of these, stainless steel an aluminum are desirable in terms of workability, handleability and cost. Thus constituting an ink-contact member, a filter, or a filter-adjoining portion substantially prevents electron transfer with an ink.

In the invention, when an ink-contact member, a filter or a filter-adjoining portion is constituted of a conductive material, it is preferred to make such the state that the corrosion current density is less than 0.03 $\mu A/cm^2$ in a polarization curve of the conductive material within an ink. Maintaining such a state can prevent unexpected ink curing (polymerization) reaction, even when a conductive material is used.

The corrosion current density can be determined through measurement of electrochemical polarization characteristics. In the invention, the corrosion current density is a value obtained from polarization characteristics through the Tafel extrapolation method, as described below.

Figure 3:
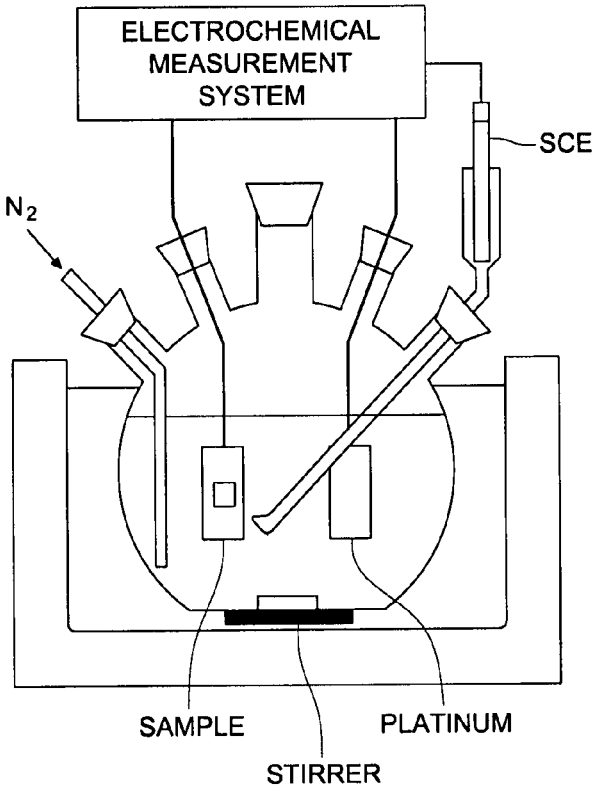
FIGS. 3(*a*) and 3(*b*) each illustrate an electrochemical measurement device, and FIG. 3(*c*) shows an example of anode and cathode polarization curves.
Figure 3:
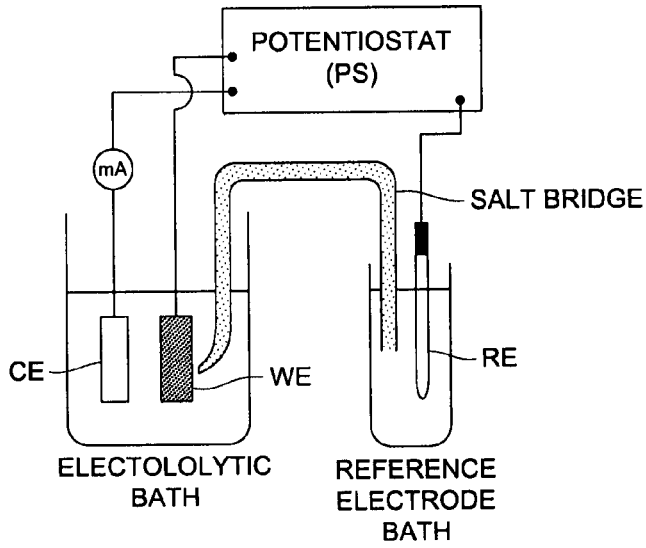
Figure 3:
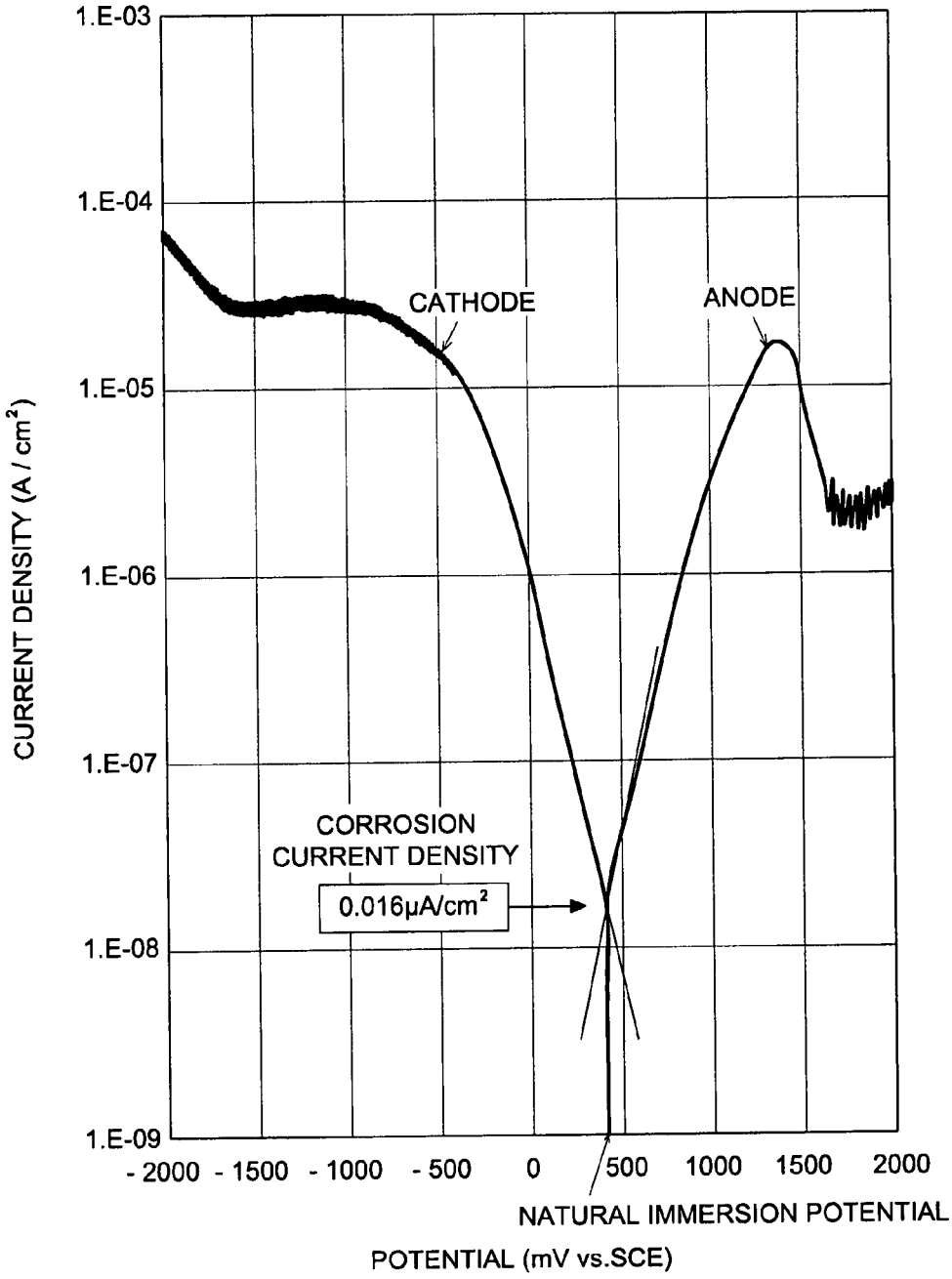

Electrochemical Measurement is conducted in a test vessel of a five-necked glass flask, as shown in FIG. 3(A) using a measurement device comprised of a sample electrode (working electrode, WE), a counter electrode (CE), a reference electrode (RE), an electrolytic bath, a reference electrode bath and a potentiostat (PS), as shown in FIG. 3(B).

A sample electrode is prepared in the manner that a sample is cut into a rectangle and a lead wire is connected thereto by spot welding and the electrode surface is subjected to polish finishing. There are used a platinum electrode as a counter electrode (CE) and a saturated calomel electrode as a reference electrode (RE).

The measurement is carried out at 70° C. in an atmospheric equilibrium for measurement of cathode polarization curve and in nitrogen gas atmosphere for measurement of anode polarization curve.

An ink as a test solution is placed into the electrolytic bath and the sample electrode is immersed in the ink for 24 hrs., then, a natural immersion electric potential is determined. Thereafter, an anode polarization curve and a cathode polarization curve are measured, while varying the potential. A corrosion current density can be determined from the intersection of a Tafel straight line of the anode or the cathode and the natural immersion potential, as shown in FIG. 3(C).

When an ink-contact member, or a filter and a filter-adjoining portion are constituted of plural different conductive materials, substantial electron transfer with an ink can be prevented by insulating each of the plural conductive materials from the other ones, for example, by providing an insulating material between different conductive materials to render an insulated state between conductive materials.

Constitution sites of an ink-jet printer, in which a conductive material is applied to an ink-contact portion, include an ink tank, a joint portion, an ink supply branch connection, an ink pump, an intermediate tank, a filter, a valve and other passages. It is essential to take the above-described constitution specifically in the filter portion having a large contact area with an ink, in the inside of an ink tank having a long ink retention time, in the vicinity of the ink tank, specifically in an intermediate tank disposed in the vanity of the recording heads.

In the ink-jet printer of the invention, a nozzle provided in the recording head has an inner diameter of 100 μm or less of a micro-pore, so that it is an essential requirement to secure removal of minute contaminants in the ink to perform stable ejection. Therefore, a filter applicable in the invention preferably has a constitution capable of removing such minute contaminants. Examples of such a filter include a single layer body of a wire mesh, so-called screen mesh, of alloys such as stainless steel, a sintered metal filter in which layers of wire mesh of an alloy such as stainless steel are layered and the respective layers are sintered, a sintered metal fiber filter in which micro-fibers of stainless steel are complexly knitted together and intersections of the fibers are sintered and a powdery metal-sintered metal filter. Of these, a box-form sintered metal fiber filter is preferred.

In the invention, relating to the foregoing (4) and (8), metal elements exhibiting an ionization tendency less than a hydrogen element include copper, mercury, silver, platinum and gold. The use of the metals elements exhibiting an ionization tendency less than a hydrogen element can substantially prevent electron transfer with an ink.

Further, the intermediate tank relating to the foregoing (9) and (10) is formed of a metal and the metal surface of the tank is preferably subjected to a passivation treatment. More preferably, the metal is aluminum, which is subjected to an alumite treatment as the passivation treatment. In the intermediate tank unit, as shown in FIG. 2(*b*), when the filter member (107) and the filter-adjoining portion (109) use different metal materials, for example, the filter is constituted of stainless steel and the filter-adjoining portion is constituted of aluminum, a potential difference is produced between both metal materials, consequently causing electron transfer with an ink. When such metal constitution is needed in terms of workability, it can be prevented by use of an aluminum material which was subjected to an alumite treatment as a passivation treatment.

The alumite treatment as a passivation treatment of the invention is also called an anodic oxidation of aluminum, in which electrolysis is undergone using an aluminum substrate as an anode to form an aluminum oxide film having a specular porous structure. The alumite treatment is readily dyeable in various colors, and black alumite is preferred in terms of minimization of light leakage.

Ink

Next, there will be described inks usable in the ink-jet printer relating to the invention.

The ink relating to the invention contains a cationic-polymerizable compound as an actinic ray-curable compound. There are used a variety of cationic-polymerizable monomers as cationic-polymerizable compounds, including compounds containing an oxirane group, such as epoxy compounds vinyl ether compounds and oxetane compounds, as described in JP-A Nos. 6-9714, 2001-31892, 2001-400682001-55507, 2001-310938, 2001-310937 and 2001-220526.

Epoxy compounds include aromatic epoxide, alicyclic epoxide and aliphatic epoxide compounds, as below.

Aromatic epoxides are preferably a di- or poly-glycidyl ether, which is prepared by the reaction of an at least one aromatic nucleus-containing polyphenols or its alkylene oxide adduct with epichlorohydrin. Examples thereof include a di- or poly-glycidyl ether of bisphenol A or its alkylene oxide adduct, a di- or poly-glycidyl ether of a hydrogenated bisphenol A or its alkylene oxide adduct, and a novolac type epoxy resin, in which ethylene oxide and propylene oxide are cited as an alkylene oxide.

An alicyclic epoxide is preferably a cyclohexane oxide or cyclopentene oxide containing compound, which is obtained by epoxidation of a compound containing a cycloalkane ring such as cyclohexane or cyclopenetene, with an appropriate oxidizing agent such as hydrogen peroxide or a peracid Preferred aliphatic epoxides include a di- or poly-glycidyl ether of an aliphatic polyhydric alcohol or its alkylene oxide. Typical examples thereof include alkylene glycol diglydyl ether such as ethylene glycol diglycidyl ether, propylene glycol diglycidyl ether or 1,6-hexanediol diglycidyl ether; and diglycidyl ether of polyalkylene glycol, e.g., polyglycidyl ether of a polyhydric alcohol such as di- or tri-glycidyl ether of glycerin or its alkylene oxide adduct, diglycidyl ether of polyethylene oxide or its polyalkylene oxide adduct and diglycidyl ether of polypropylene glycol or its alkylene oxide adduct.

Of these epoxides, an aromatic epoxide or an alicyclic epoxide is preferred in terms of quick-curability, and an alicyclic epoxide is specifically preferred. In the invention, epoxides, as described above may be used alone or in combination thereof.

In the invention, as an epoxy compound containing an oxirane group, at least one of an epoxidated fatty acid ester and an epoxidated fatty acid glyceride is specifically preferred in terms of safety such as AMES or sensitization property.

Any one of epoxy group-introduced fatty acid esters and fatty acid glycerides is usable as an epoxidated fatty acid ester and an epoxidated fatty acid glyceride. As an epoxidated fatty acid are used, for example, methyl epoxystearate, butyl epoxystearate and octyl epoxystearate. Epoxydated fatty acid glycerides are prepared by epoxidation of soybean oil, epoxidated linseed oil or caster oil, such as epoxydated soybean oil, epoxydated linseed oil and epoxidated caster oil.

To achieve enhanced curability and ejectability, photopolymerizable compounds used in the invention preferably comprise 30-95% by mass of a compound containing an oxetane ring, 5-70% by weight of a compound containing a oxirane group and 0-40% by weight a vinyl ether compound.

Oxetane compounds usable in the invention include those known in the art, as described in JP-A Nos. 2001-220526 and 2001-310937.

Vinyl ether compounds usable in the invention include, for example, di- or tri-vinyl ether compounds such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether and trimethylolpropane trivinyl ether; and monovinyl ether compounds such as ethyl vinyl ether, n-butyl vinyl ether, isobutyl vinyl ether, octadecyl vinyl ether, cyclohexyl vinyl ether, hydroxylbutyl vinyl ether2-ethylhexyl vinyl ether, cyclohexanedimethanol monovinyl ether, n-propyl vinyl ether, isopropyl vinyl ether, isopropenyl ether-O-propylene carbonate, dodecyl vinyl ether, diethylene glycol monovinyl ether, and octadecyl vinyl ether. Of these vinyl ether compounds, di- or tri-vinyl ether compounds are preferred and divinyl ether compounds are specifically preferred. the foregoing vinyl ether compounds may be used singly or in combination thereof.

In the invention, the ink containing a cationic-polymerizable compound preferably contains, as a polymerization initiator, a photo-acid generator (which is, a photolytically acid-generating agent). Photo-acid generators usable invention, for example, compounds employed in a chemical amplification type photo-resist or photo-cationic-polymerization are used ("Imaging-yo Yukizairyou (Organic Material for Imaging)" edited by Yuki Electronics Zairyo Kenkyukai, published by Bunshin Shuppan (1993) page 187-192). Examples of compounds suitable in the invention are cited below.

First, there are cited $B(C_6F_6)_4^-$, $PF_6$, $AsF_6^-$, $SbF_6^-$, or $CF_3SO_3^-$ salts of aromatic onium compounds such as diazonium, ammonium, iodonium, sulfonium or phosphonium.

Specific example of onium compounds usable in the invention are shown below.

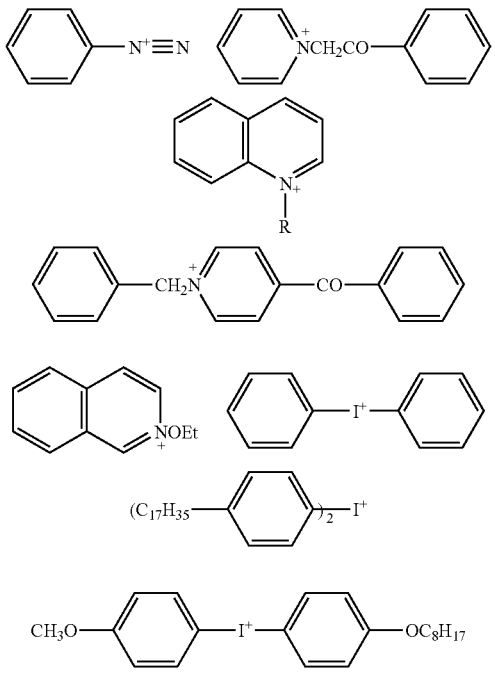

-continued

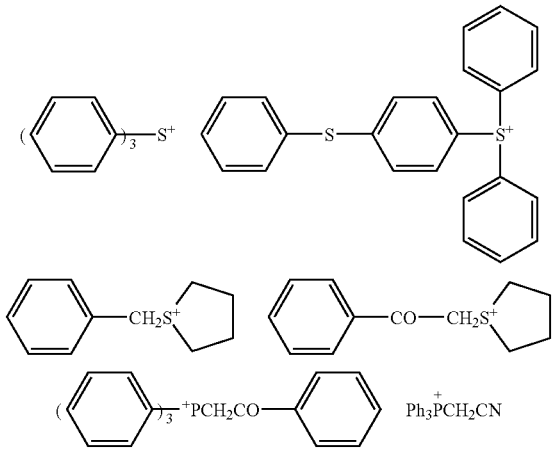

Further, there are cited sulfonated compounds capable of generating sulfonic acid and specific examples thereof are shown below.

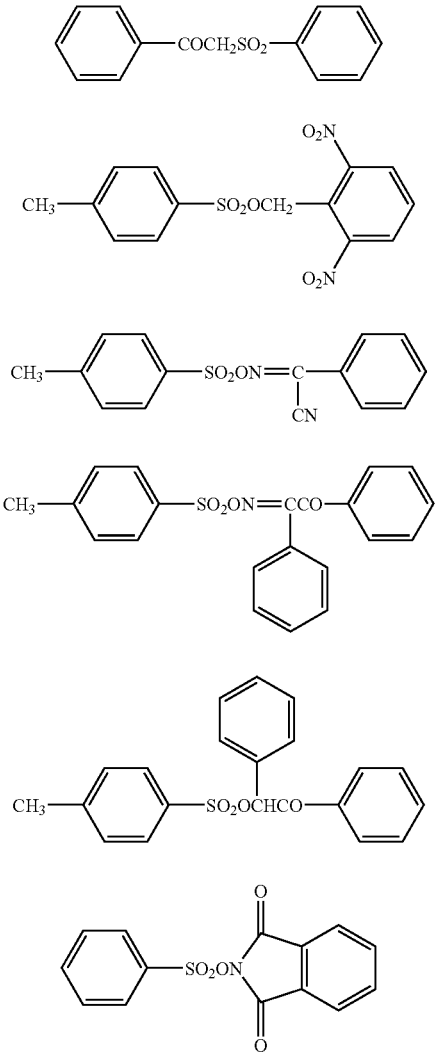

-continued

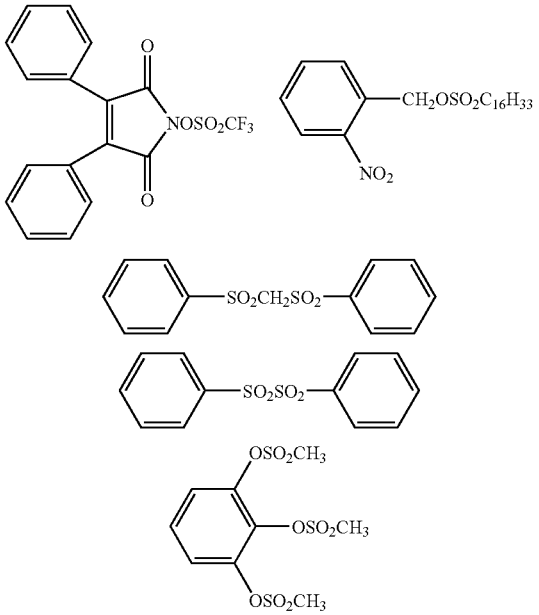

Further, there are also usable halogenated compounds which photolytically generate a hydrogen halide and specific example thereof are shown below.

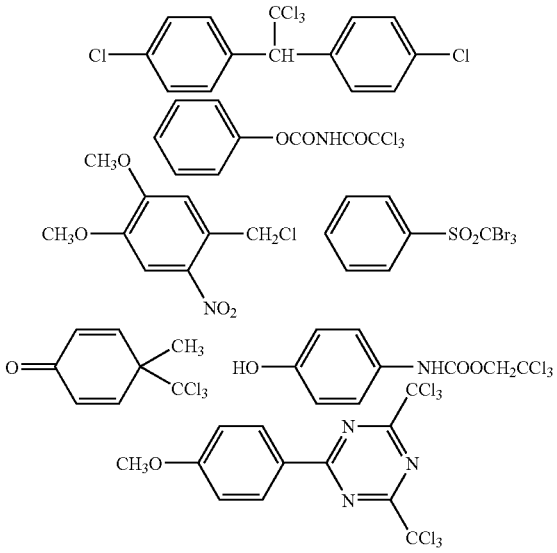

Further, there are cited iron allene complexes.

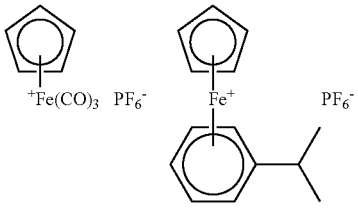

The foregoing photo-acid generator (photo-cationic-polymerization initiator) is contained preferably in an amount of 0.2 to 20 parts by mass based on 100 parts by mass of cationic-polymerizable monomer. A content of less than 0.2 parts by mass is difficult to obtain cured material and a content exceeding 10 parts by mass cannot expect further enhanced curing effect. These photo-cationic-polymerization initiators may be used singly or in combination thereof.

The ink relating to the invention preferably contains colorant materials and pigments are preferred as a colorant.

Pigments for use in the inks usable in the invention preferably are organic pigments which were subjected to an acid or basic surface treatment. A dispersing agent is contained preferably in an amount of 35 to 65% by mass based on pigment. In the ink, when a dispersing agent is contained at less than 35%, insufficient adsorption of the dispersing agent onto the pigment surface often results in insufficient dispersion stability and when the content exceeds 65%, a dispersing agent which is not adsorbed onto the pigment surface is liberated into the ink, causing polymerization inhibition. An amine value is preferably more than an acid value and the difference thereof is preferably not less than 1 mg/gKOH and less than 10 mg/gKOH. A difference of less than 1 mg/gKOH exhibits no effect and a difference of not less than 10 mg/gKOH requires an excessive basic treatment, leading to cost-up and causes for polymerization inhibition.

Pigments usable in the invention include inorganic pigments, for example, carbon pigments such as carbon black, carbon refined and carbon nanotube; metal oxide pigments such as iron black, cobalt blue, zinc oxide, titanium oxide, chromium oxide, and iron oxide; sulfide pigments such as zinc sulfide; phthalocyanine pigments; metal salt pigments such as metal sulfate, carbonate, silicate, or phosphate; metal powder such as aluminum powder, bronze powder and zinc powder; and organic pigments, for example, nitro pigments, nitroso pigments such as aniline black or naphthol green, azo pigments (including azo lake, insoluble azo pigments, condensed pigments, chelate azo pigments) such as Bordeaux 10B, lake red 4R and chromophthal red; lake pigments such as peacock blue and rhodamine lake; phthalocyanine pigments such as phthalocyanine blue; polycyclic pigments (perylene pigments, perynone pigments, anthraquinone pigments, quinacrydone pigments, dioxane pigments, thioindigo pigments, isoindolinone pigments, quinofuran pigments); thren pigments such as thioindigo red and indanthrone blue; quinacrydone pigments, quinacrydine pigments and isoindolinone pigments.

Specific examples of pigments are as below.

C.I. Pigment Yellow—1, 3, 12, 13, 14, 16, 17, 42, 73, 74, 81, 83, 87, 93, 95, 97, 98, 109, 114, 120, 128, 129, 138, 150, 151, 154, 180, 185;

C.I. Pigment Orange—16, 36, 38;

C.I. Pigment Red—5, 7, 22, 38, 48:1, 48:2, 48:4, 49:1, 53:1, 57:1, 63:1, 101, 112, 122, 123, 144, 146, 168, 184, 185, 202;

C.I. Pigment Violet—19, 23;

C.I. Pigment Blue—1, 2, 3, 15:1, 15:2, 15:3, 15:4, 18, 22, 27, 29, 60;

C.I. Pigment Green—7, 36;

C.I. Pigment White—6, 18, 21;

C.I. Pigment Black—7.

Pigments described above can be dispersed using, for example, a ball mill, sand mill, atreiter, roll mill, agitator, Henschel mixer, colloid mill, ultrasonic homogenizer, pearl mill, wet jet mixer or paint shaker. There may be added dispersing agents when dispersing a pigment. Such a dispersing agent preferably is a polymeric dispersing agent and examples of a polymeric dispersing agent include Solsperse series, available from Avecia Co. A dispersing agent or a dispersing aid is incorporated preferably in an amount of from 1 to 50 parts by weight, based on 100 parts by weight of the pigment. There may be used a solvent or polymeric compound as a dispersing medium but the ink composition of this invention preferably contains no solvent to cause a reaction and curing immediately after deposition. A solvent remaining in a cured image produces problems such as deteriorated solvent resistance and VOC of the residual solvent. Polymeric compounds, rather than solvents are preferably used as a dispersing medium and in terms of dispersing suitability, it is preferred to choose monomers exhibiting viscosity as low as possible.

Pigment particles preferably have an average particle size of from 0.08 to 0.5 μm, and pigments, dispersing agents and dispersing medium are to be appropriately chosen and dispersing and filtering conditions are optimized so that the maximum particle size falls within the range from 0.3 to 10.0 μm and preferably from 0.3 to 3.0 μm. This particle size control can inhibit clogging in a head nozzle and maintains ink storage stability, ink transparency and curing sensitivity. In the ink of the invention, the concentration of colorant material is preferably from 1 to 10% by mass of the total ink.

In addition to the foregoing, the ink composition may further contain various additives. Examples thereof include leveling additives, matting agents, polyester type resins, polyurethane type resins, vinyl type resins, acryl type resins, rubber type resins and waxes to control physical properties of film. There are usable commonly known basic compounds for the purpose of improvement of storage stability. Typical examples thereof include basic or organic compounds such as basic alkali metal compounds, alkaline earth metal compounds, and amines. Further, there is feasible a hybrid radical/cation curing ink in combination with a radical polymerizable monomer and initiator.

In the invention, it is preferred to make the state that the corrosion current density within an ink is less than 0.03 $\mu A/cm^2$ in a polarization curve of a conductive material. To make such a state, it is preferred to incorporate to an ink commonly known corrosion inhibitors, such as fatty acid amine salts, amine compounds, benzotriazole compounds or mercapto compounds or to control a water content of the ink (or control of electrolyte content).

The ink relating to the invention preferably exhibits a viscosity of 7 to 50 mPa at 25° C. for use in image formation.

There can be employed a variety of recording mediums by using the ink relating to the invention in the ink-jet printer of the invention. To realize advantageous characteristics of the ink relating to the invention are preferred non-absorptive recording mediums. As non-absorptive recording material are usable various kinds of non-absorptive plastics and their films as well as conventional non-coated paper and coated paper. Examples of plastic film include polyethylene terephthalate (PET) film, stretched polystyrene (OPS) film, stretched polypropylene (OPP) film, stretched nylon (ONy) film, polyvinyl chloride (PVC) film, polyethylene (PE) film, and triacetyl cellulose (TAC) film. Other plastics include polycarbonate, acryl resin, ABS, polyacetal, polyvinyl alcohol (PVA), and various rubbers. Further, metals and glass are also feasible. When images are formed on thermally shrinkable PET film, OPS film, OPP film, ONy film or PVC film, the constitution of this invention is effective. These substrates easily curl or deform at the time of curing shrinkage or curing reaction of the ink and it is difficult for the ink layer to follow shrinkage of the substrate.

Various kinds of plastic films greatly differ in surface energy, resulting in problems arising from dot size change after deposition. This invention is applicable not only to plastic film exhibiting a relative low surface energy such as OPP film and OPS film but also to PET film exhibiting a relatively high surface energy, and a substrate exhibiting a wet index of 35 to 60 mN/m.

In the invention, a long-roll (web) recording material is advantageously used in terms of cost of the recording material such as packaging cost or production cost and print making efficiency.

EXAMPLES

The present invention will be described with reference to examples but are by no means limited to these. In Examples, "part(s)" and "%" represent part(s) by mass and % mass, unless otherwise noted.

Example 1

Preparation of Ink

Cyan Ink:

There was prepared a cyan ink having the composition, as described below.

First, to a solution obtained by dissolving the total amount of PB822 (dispersant, produced by Ajinomoto Fine Techno Co., Ltd.) and 14 parts of oxetane OXT 221 with stirring and heating at 65° C. for 1 hr. on a hot plate was added the total amount of pigment C.I. Pigment Blue 15:4 and was sealed together with 3 mm zirconia beads into a glass bottle. After dispersed by a paint shaker for 4 hrs., the zirconia beads were removed and a dispersion was prepared.

Subsequently, to the prepared dispersion were added additives described below to prepare a cyan ink. The composition of the final cyan ink is as below:

| | |
|---|---|
| Pigment: C.I. Pigment Blue 15:4 | 4.0 parts |
| Agisver PB822 (dispersant, produced by Ajinomoto Fine Techno Co., Ltd.) | 2.0 parts |
| Oxetane OXT 221 (oxetane compound, produced by TOAGOSEI CO., LTD) | 71.0 parts |
| Oxetane OXT 212 (oxetane compound, produced by TOAGOSEI CO., LTD) | 5.0 parts |
| Oxetane OXT 101 (oxetane compound, produced by TOAGOSEI CO., LTD) | 5.0 parts |
| Alicyclic epoxy compound 1 | 18.0 parts |
| Photpolymerization initiator (M.W. 466, containing 3 aryl group per molecule) | 4.0 parts |
| Polymerization inhibitor (tri-isopropanolamine) | 0.1 parts |
| Hydroquinone | 0.1 part |
| Water | 1.0 part |

OXT-221

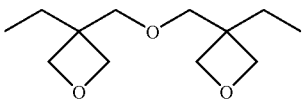

OXT-211

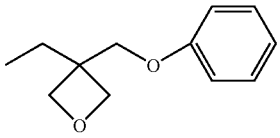

-continued

OXT-212

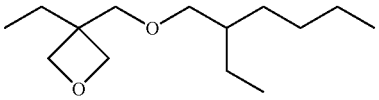

Alicyclic epoxy compound 1

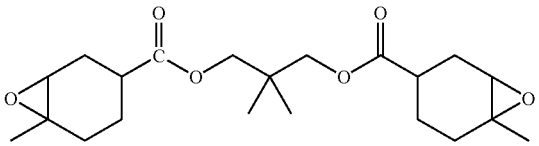

Photopolymerization initiator 1

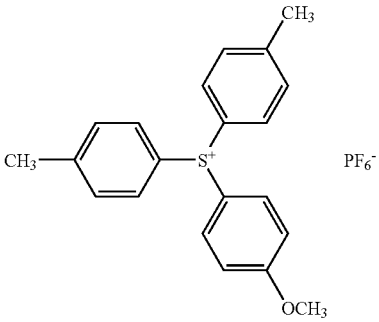

Yellow Ink:

A yellow ink was prepared similarly to the foregoing cyan ink, except that the pigment (C.I. Pigment Blue 15:4) was replaced by C.I. Pigment Yellow 150.

Magenta Ink:

A magenta ink was prepared similarly to the cyan ink, except that the pigment (C.I. Pigment Blue 15:4) was replaced by C.I. Pigment Red 122.

Black Ink:

A black ink was prepared similarly to the cyan ink, except that the pigment (C.I. Pigment Blue 15:4) was replaced by C.I. Pigment Black 7.

Ink-Jet Printer

There were prepared ink-jet printers Nos. 1-5 having an ink supply line constitution shown in FIG. 2(*a*), in which an ink tank (101) and joints (J1 and J2) were constituted of the materials, as shown in Table 1. Polyethylene resin, as an insulating member described in Table 1 was used in the ink-contact portions of an ink tank to cover the surface thereof to insulate it. The ink supply passage 102 was constituted of an ink-resistant Teflon (trade name) tube as an insulating member, which was covered with a black polyolefin tube.

Evaluation

Precipitation Resistance

Using the prepared inks, each of the ink-jet printers was evaluated with respect to precipitation resistance. Thus, the portion inclusive of the ink tank to the joint J2 was filled with each of the inks and allowed to stand at 23° C. for 3 days. Thereafter, the presence/absence of precipitates in the ink tank 101 and at the joint J1 was visually observed to evaluation precipitation resistance. The obtained results are shown in Table 1.

TABLE 1

| Ink Jet Printer No. | Joint Material | Ink Tank Material | Insulating Member*4 | Precipitation*5 | Remark |
|---|---|---|---|---|---|
| 1 | St*1 | Al*2 | No | Yes | Comp. |
| 2 | St | St | No | No | Inv. |
| 3 | Al | Al | No | No | Inv. |
| 4 | St | *3 | No | No | Inv. |
| 5 | St | Al | Yes | No | Inv. |

*1Stainless steel
*2Aluminum
*3: Alumite-treated aluminum
*4Presence/absence of insulating member
*5Presence/absence of precipitation As can be seen from Table 1, ink-jet printer (1) in which the joint portion and the ink tank were constituted of different metal materials produced precipitates as a result of contact with the ink having a cationic polymerizable composition over a long period. On the contrary, it was proved that ink-jet printers (2, 3) which were each constituted of the same kind of a metal, ink-jet printer (4) in which an alumite-treated aluminum was used, and ink-jet printer (5) which was constituted of different metals but the ink-contact portion thereof was covered with an insulating material, each prevented precipitation.

Example 2

Ink-Jet Printer

There were prepared ink-jet printers Nos. 6-13 having an ink supply line constitution provided with a filter box shown in FIG. 2(*c*), in which a filter (107) and filter-adjoining portion (111) were constituted of materials, as shown in Table 2. Polyethylene resin as an insulating material of Table 2 was used, covering the overall surface of the ink-contact portion in the filter-adjoining portion to insulate it. The ink supply passage 102 was constituted of an ink-resistant Teflon (trade name) tube as an insulating member, which was covered with a black polyolefin tube. Each of the joints was the same as a material used for the filter-adjoining portion.

Evaluation

Precipitation Resistance

Using the prepared inks, each of the ink-jet printers was evaluated with respect to precipitation resistance. Thus, the portion inclusive of the ink tank to the joint J2 was filled with each of the inks and allowed to stand at 23° C. for 3 days. Thereafter, the presence/absence of precipitates in the interior of the filter box was visually observed to evaluate precipitation resistance.

Ejection Stability

After each of the inks was allowed to stand within the foregoing ink supply line for 3 days under an environment of 23° C., continuous ejection was conducted over a period of 3 hrs. by using a recording head having the nozzle number of 256, capable of ejecting multi-size dots of 2 to 20 pl at a resolution of 720×720 dpi ("dpi" represents the number of dots per 2.54 cm), heated at 50° C. Subsequently, the ejection state of each of the color inks was visually observed to determine an average ejection state of each color ink and evaluated with respect to ejection stability, based on the following criteria:

A: no occurrence of nozzle clogging and curved ejection was observed,

B: no occurrence of nozzle clogging was observed but a few nozzles exhibiting curved ejection was observed, C: nozzle clogging and curved ejection were apparently observed and was unacceptable in practice.

Results are shown in Table 2.

TABLE 2

| Ink Jet Printer No. | Filter Material | Filter Box Material | Insulating Member*7 | Precipitation*7 | Ejection Stability | Remark |
|---|---|---|---|---|---|---|
| 6 | St*1 | Al*2 | No | Yes | C | Comp. |
| 7 | St | St | No | No | A | Inv. |
| 8 | Al | Al | No | No | A | Inv. |
| 9 | Cu*3 | Cu | No | No | A | Inv. |
| 10 | Cu | Al | No | Yes | C | Comp. |
| 11 | Cu | Ag*4 | No | No | A | Inv. |
| 12 | St | *5 | No | No | A | Inv. |
| 13 | St | Al | Yes | No | A | Inv. |

*1Stainless steel
*2Aluminum
*3Copper
*4Silver
*5: Alumite-treated aluminum
*6Presence/absence of insulating member
*7Presence/absence of precipitation As apparent from Table 2, it was proved that in ink-jet printers 6 and 10 in which the filter of the filter box and the filter-adjoining portion were constituted of different conductive materials, contact with an ink containing cationic-polymerizable composition resulted in formation of precipitates, leading to poor ejection stability. On the contrary, in ink-jet printers 11 which were constituted of the same metal, ink-jet printer 11 which used copper or silver exhibiting an ionization tendency less than hydrogen, ink-jet printer 12 which used as alumite-treated aluminum and ink-jet printer 13 which was constituted of different metals in which the ink contact portion was covered with an insulating material, electron transfer with the ink was prevented, inhibiting formation of precipitates and causing no nozzle clogging at the time of continuous ejection, leading to superior ejection stability.

Example 3

There were prepared ink-jet printers 14-21 having an ink supply line provided with an intermediate tank unit, as shown in FIG. 2(B), in which the filter 107 and the filter-adjoining portion were each constituted of materials shown in Table 3. Polyethylene resin as an insulating material of Table 3 was used, covering the overall surface of the ink-contact portion in the filter-adjoining portion to insulate it. The ink supply passage 102 was constituted of an ink-resistant Teflon (trade name) tube as an insulating member, which was covered with a black polyolefin tube. Each of the joints was the same as a material used for the filter-adjoining portion.

Evaluation

Similarly to Example 2, evaluation was made with respect to precipitation resistance in the interior of the intermediate tank unit and ejection stability. Results are shown in Table 3.

TABLE 3

| Ink Jet Printer No. | Filter Material | Intermediate Tank Member | Insulating Member*6 | Precipitation*7 | Ejection Stability | Remark |
|---|---|---|---|---|---|---|
| 14 | St*1 | Al*2 | No | Yes | C | Comp. |
| 15 | St | St | No | No | A | Inv. |
| 16 | Al | Al | No | No | A | Inv. |
| 17 | Cu*3 | Cu | No | No | A | Inv. |
| 18 | Cu | Al | No | Yes | C | Comp. |
| 19 | Cu | Ag*4 | No | No | A | Inv. |
| 20 | St | *5 | No | No | A | Inv. |
| 21 | St | Al | Yes | No | A | Inv. |

*1Stainless steel
*2Aluminum
*3Copper
*4Silver
*5: Alumite-treated aluminum
*6Presence/absence of insulating member
*7Presence/absence of precipitation As apparent from Table 3, it was proved that in ink-jet printers 14 and 18 in which the filter of the filter box and the filter-adjoining portion were constituted of different conductive materials, contact with an ink containing cationic-polymerizable composition resulted in formation of precipitates, leading to poor ejection stability. On the contrary, in ink-jet printers 15-17 which were constituted of the same metal, ink-jet printer 19 which used copper or silver exhibiting an ionization tendency less than hydrogen, ink-jet printer 20 which used an alumite-treated aluminum and ink-jet printer 21 which was constituted of different metals in which the ink contact portion was covered with an insulating material, electron transfer with the ink was prevented, inhibiting formation of precipitates and causing no nozzle clogging at the time of continuous ejection, leading to superior ejection stability.

Example 4

Similarly to Examples 1-3, inks were prepared and the ink-jet printers using the inks were evaluated, provided that photo-polymerization initiator 1 used for the ink preparation was replaced by photopolymerization initiator 2, as below. There were obtained results similar to the Tables 1-3.

Photopolymerization Initiator 2

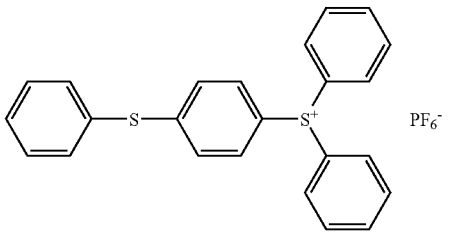

Example 5

Similarly to Examples 1-3, inks were prepared and the ink-jet printers using the inks were evaluated, provided that alicyclic epoxy compound 1 used for the ink preparation was replaced by photopolymerization initiator 2. There were obtained results similar to the Tables 1-3.

Example 6

Similarly to Examples 1-3, inks were prepared and the ink-jet printers using the inks were evaluated, provided that the water content of the respective inks used in Examples 1-3 (0.9%) was changed to 0.1%, 0.3%, 0.5%, 1.5%, 2.0%, 2.5%, 3.0%, 3.5% or 5.0%. It was confirmed that superior results were achieved in the range of 0.5-3.0% of the water content.

Example 7

Inks were prepared similarly to Example 1, provided that 0.1 parts of a polymerization inhibitor (triisopronolamine) and 1.0 part of water were removed (comparative ink) or replaced by a corrosion inhibitor and water, as shown in Table 4 (inventive ink). Using the ink-jet printers 2 and 15, these inks were evaluated with respect to precipitation resistance and ejection stability. The results thereof are shown in Table 4, in which measured values within the respective inks are also shown.

TABLE 4

| Ink Jet Printer No. | Joint Material | Ink Tank Material | Corrosion Inhibitor (%) | Water Content (%) | Corrosion Current Density ($\mu A/cm^2$) | Precipitation*3 | Ejection Stability | Remark |
|---|---|---|---|---|---|---|---|---|
| 2 | St*1 | St | — | 0.4 | 0.042 | Yes | C | Comp. |
| 2 | St | St | TIPA*2 (0.05) | 1.3 | 0.035 | Yes | C | Comp. |
| 2 | St | St | Z-1 (0.05) | 0.4 | 0.020 | No | A | Inv. |
| 2 | St | St | Z-2 (0.1) | 0.4 | 0.016 | No | A | Inv. |
| 2 | St | St | Z-3 (0.1) | 0.4 | 0.014 | No | A | Inv. |
| 2 | St | St | Z-4 (0.05) | 1.0 | 0.024 | No | A | Inv. |
| 2 | St | St | Z-5 (0.05) | 1.0 | 0.026 | No | A | Inv. |
| 15 | St | St | — | 0.4 | 0.750 | Yes | C | Comp. |
| 15 | St | St | Z-1 (0.075) | 0.4 | 0.025 | No | A | Inv. |
| 15 | St | St | Z-2 (0.15) | 0.4 | 0.022 | No | A | Inv. |
| 15 | St | St | Z-3 (0.15) | 0.4 | 0.021 | No | A | Inv. |
| 15 | St | St | Z-4 (0.1) | 1.0 | 0.028 | No | A | Inv. |
| 15 | St | St | Z-5 (0.1) | 1.0 | 0.028 | No | A | Inv. |

*1: Stainless steel
*2: TIPA: triisopropanolamine
*3: Presence/absence of precipitation

Z-1

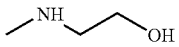

Z-2

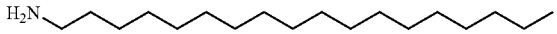

Z-3

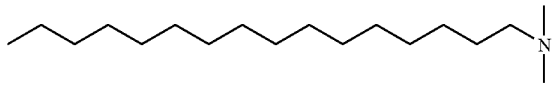

Z-4

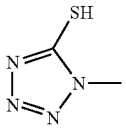

Z-5

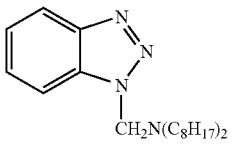

What is claimed is:

1. An ink-jet printer ejecting an ink comprising a cationic-polymerizable compound onto a recording medium, wherein the ink jet printer comprises ink-contact members which constitute an ink tank retaining the ink and an ink supply passage from the ink tank to a recording head ejecting the ink and the ink-contact members are each comprised of a material which does substantially not undergo electron transfer with the ink and wherein the ink-contact members are comprised of at least one electrically conductive material exhibiting less than 0.03 $\mu A/cm^2$ of a corrosion current density in the ink.

2. The ink jet printer of claim 1, wherein all of the ink-contact members are each comprised of an insulating material.

3. The ink jet printer of claim 1, wherein at least a part of the ink-contact members is comprised of a single electrically conductive material.

4. The ink jet printer of claim 1, wherein at least a part of the ink-contact members is comprised of at least two electrically conductive materials, and the two electrically conductive materials being insulated from each other.

5. The ink jet printer of claim 1, wherein the ink-contact members are each comprised of a metal element exhibiting an ionization tendency that is smaller than hydrogen.

6. The ink jet printer of claim 1, wherein the ink tank or an intermediate tank provided between the ink tank and the recording head is comprised of a metal having a surface which was subjected to a passivation treatment.

7. The ink jet printer of claim 1, wherein the ink further comprises a photo-acid generator.

8. The ink-jet printer of claim 1, wherein the ink has a water content of not less than 0.5% by mass and not more than 3.0% by mass.

9. An ink-jet printer ejecting an ink comprising a cationic-polymerizable compound onto a recording medium, wherein the ink jet printer comprises ink-contact members which constitute an ink tank retaining the ink and an ink supply passage of from the ink tank to a recording head ejecting the ink and the ink-contact members are each comprised of a material which does substantially not undergo electron transfer with the ink and wherein the ink-contact members are each comprised of a metal element exhibiting an ionization tendency that is smaller than hydrogen.

10. The ink jet printer of claim 9, wherein all of the ink-contact members are each comprised of an insulating material.

11. The ink-jet printer of claim 9, wherein at least a part of the ink-contact members is comprised of at least two electrically conductive materials, and the two electrically conductive materials being insulated from each other.

12. The ink jet printer of claim 9, wherein the ink tank or an intermediate tank provided between the ink tank and the recording head is comprised of a metal having a surface which was subjected to a passivation treatment.

13. The ink jet printer of claim 9, wherein the ink further comprises a photo-acid generator.

14. The ink-jet printer of claim 9, wherein the ink has a water content of not less than 0.5% by mass and not more than 3.0% by mass.

15. An ink-jet printer ejecting an ink comprising a cationic-polymerizable compound onto a recording medium, wherein the ink jet printer comprises ink-contact members which constitute an ink tank retaining the ink and an ink supply passage of from the ink tank to a recording head ejecting the ink and the ink-contact members are each comprised of a material which does substantially not undergo electron transfer with the ink and wherein the ink tank or an intermediate tank provided between the ink tank and the recording head is comprised of a metal having a surface which was subjected to a passivation treatment.

16. The ink jet printer of claim 15, wherein all of the ink-contact members are each comprised of an insulating material.

17. The ink- jet printer of claim 15, wherein at least a part of the ink-contact members is comprised of at least two electrically conductive materials, and the two electrically conductive materials being insulated from each other.

18. The ink jet printer of claim 15, wherein the metal is aluminum and the passivation treatment is an alumite treatment.

19. The ink jet printer of claim 15, wherein the ink further comprises a photo-acid generator.

20. The ink-jet printer of claim 15, wherein the ink has a water content of not less than 0.5% by mass and not more than 3.0% by mass.

* * * * *